United States Patent [19]

Carpenter

[11] Patent Number: 4,616,980

[45] Date of Patent: Oct. 14, 1986

[54] CANNED MOTOR PUMPS PRESSURIZED RECIRCULATION SYSTEM

[75] Inventor: Richard G. Carpenter, Doylestown, Pa.

[73] Assignee: Crane Co., New York, N.Y.

[21] Appl. No.: 745,811

[22] Filed: Jun. 10, 1985

Related U.S. Application Data

[63] Continuation of Ser. No. 558,602, Dec. 6, 1983, abandoned.

[51] Int. Cl.[4] ..... F04B 17/00

[52] U.S. Cl. ..... 417/357; 417/368; 417/369

[58] Field of Search ..... 417/357, 366, 367, 368, 417/369, 370, 371

[56] References Cited

U.S. PATENT DOCUMENTS

| | | | |
|---|---|---|---|
| 2,249,882 | 7/1941 | Buchanon | 417/370 |
| 2,810,348 | 10/1957 | White | 417/370 |
| 3,088,042 | 4/1963 | Robinson | 417/371 |
| 3,122,894 | 3/1964 | Bernhard | 417/366 |
| 3,318,253 | 5/1967 | Campolong | 417/367 |
| 3,572,976 | 3/1971 | Sato | 417/369 |
| 4,013,384 | 3/1977 | Oikawa | 417/368 |

FOREIGN PATENT DOCUMENTS

| | | | |
|---|---|---|---|
| 148996 | 11/1980 | Japan | 417/369 |
| 148997 | 11/1980 | Japan | 417/369 |
| 567190 | 9/1975 | Switzerland | 417/369 |

*Primary Examiner*—Carlton R. Croyle
*Assistant Examiner*—Donald E. Stout
*Attorney, Agent, or Firm*—Fitzpatrick, Cella, Harper & Scinto

[57] ABSTRACT

A canned motor pump pressurized recirculation system which comprises a main unit and a recirculation line. The main unit includes a main pump, an auxiliary pump and motor means positioned between the main and the auxiliary pumps for driving the pumps. The recirculation line is positioned external of the main unit, and is connected thereto between the pumps. The recirculation line is adapted to pass fluid therethrough such that the fluid will be passed by the auxiliary pump through the motor means to the high pressure portion of the main pump. The auxiliary impeller is adapted for easy replacement by impellers of various sizes.

5 Claims, 2 Drawing Figures

CANNED MOTOR PUMPS PRESSURIZED RECIRCULATION SYSTEM

This application is a continuation of application Ser. No. 558,602 filed Dec. 6, 1983, now abandoned.

BACKGROUND OF THE INVENTION

1. Field of the Invention

This invention relates to a canned motor pump pressurized recirculation system and, more particularly, to a canned motor pump pressurized recirculation system having an auxiliary pump to effect pressurization of the system.

2. Description of the Prior Art

In conventional canned motor pumps, some of the fluid which has been pumped is recirculated from the high pressure portion of the pump through the motor to the impeller in the low pressure or suction portion of the pump. This recirculation fluid absorbs heat from the motor which heat can result in vaporization or boiling of the fluid when it is returned to the low pressure portion of the pump. Vaporization of the fluid results in a vapor lock which causes the bearings of the motor to fail and the motor to burn out.

A known method to overcome such vaporization in the pump is "reverse circulation" wherein the recirculated fluid is directed from the discharge of the high pressure portion of the pump through the motor at a controlled temperature and pressure, and then is piped back to a low pressure or suction reservoir in a customer's system. However, the problem with reverse circulation is that the control conditions for each customer's system may vary and therefore no unifrom operational instructions can be employed. For instance, if customer's recirculation piping has low flow resistance, fluid in the motor will have a low back pressure so that it may boil. If the recirculation piping has high flow resistance, the amount of fluid flow is low and therefore the fluid in the motor will vaporize causing the motor to burn out.

The Hermetic Pump Company, Freiburg, Germany has devised a pump which attempts to overcome the problems of reverse circulation. In particular, fluid is taken from the discharge portion of a main impeller through the shaft of the pump to an auxiliary impeller which is located in the rotor portion of the cavity of the motor. The auxiliary impeller directs the recirculated fluid through the cavity of the motor back to the discharge portion of the main impeller. However, some of the disadvantages of the system are that the flow from the main impeller to the auxiliary impeller is limited by the size of the shaft of the pump, and alternatively if one wishes to reduce the flow this would be difficult since the path of the flow is located in the pump. Also, since the auxiliary impeller is inside the cavity for the rotor, the size of the auxiliary impeller is limited.

SUMMARY OF THE INVENTION

The present invention relates to a canned motor pump pressurized recirculation system which provides for improved pressurization of fluid used to cool the motor and bearings. Specifically, the pump system includes a main unit having a main pump, an auxiliary pump, and motor means positioned between the main and the auxiliary pumps for driving the pumps. In addition, there is also provided a recirculation line positioned external of the main unit and connected thereto between the main and the auxiliary pumps. The recirculation line is adapted to pass fluid therethrough such that the fluid will be passed by the auxiliary pump through the motor means to the high pressure portion of the main pump while maintaining the recirculated fluid at or near discharge pressure.

DESCRIPTION OF THE PREFERRED EMBODIMENTS

Figure 1:
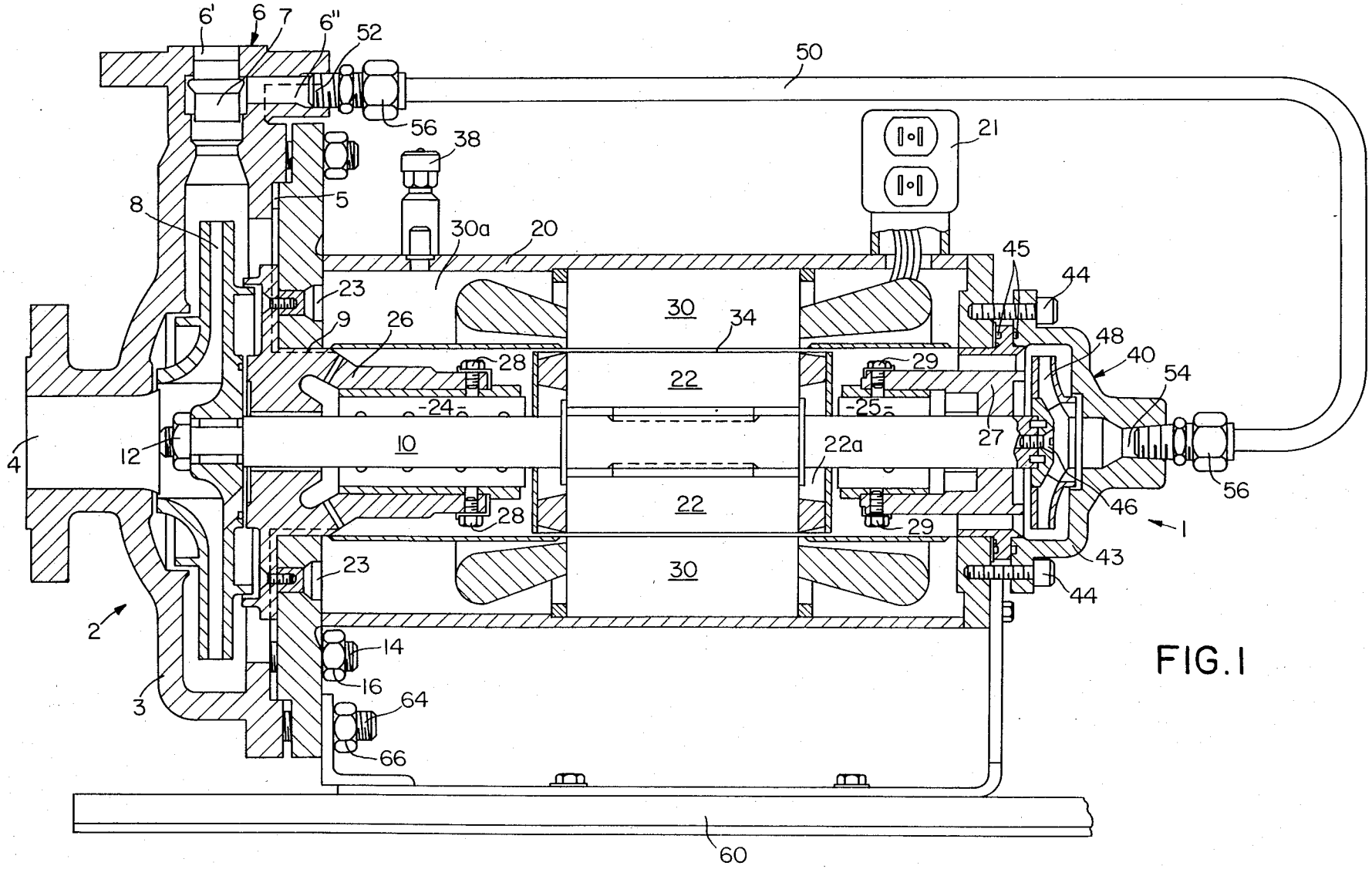
FIG. 1 is a longitudinal, central-sectional view of a first embodiment of the canned motor pump pressurized recirculation system of the present invention.

In FIG. 1, a canned motor pump pressurized recirculation system according to the present invention is generally represented by reference numeral 1. The system includes a main pump 2 having a casing 3 which includes an inlet or low pressure portion 4, a discharge or high pressure portion 6 with a primary portion 6' and a secondary portion 6'' and an impeller 8. Impeller 8 is secured on a shaft 10 by a retaining nut 12 in the usual manner, and rotatable with the shaft such that the rotation of the impeller transfers fluid from the low pressure portion 4 to the high pressure portion 6 of the main pump casing 3. Discharge portion 6 has in a section 7 thereof a filter which extends motor and bearing life by keeping the fluid free of particles.

The main pump casing 3 is secured to a motor housing 20 by conventional studs 14 and nuts 16, as shown and having seals 5 therebetween to avoid fluid leakage.

Motor housing 20, which is removably mounted onto a base 60 by conventional studs 64 and nuts 66, as shown, defines a cavity for the motor. The motor includes a rotor 22 which is secured to main shaft 10 and adapted ot rotate therewith, and a stator 30 which is positioned to surround rotor 22 but is spaced thereform. Actually, rotor 22 is in an enclosed portion **22*a* of the motor's cavity and stator 30 is in another enclosed portion 30*a* of the motor's cavity with the separation between both portions defining a sleeve 34. Sleeve 34 permits fluid to flow from an auxiliary pump casing 43 to main pump casing 3 while preventing fluid from entering the portion 30a which encloses or "cans" stator 30. (It is well known in the art that the term "canned" or "cans" means that the stator of a motor is sealed in an enclosure.) Means, such as electrical terminal 21, is provided on motor housing 20 through which the motor receives electrical power from an external source. Shaft 10 is supported in motor housing 20 by front bearing 24 and rear bearing 25 which are held in place by front bearing housing 26 and rear bearing housing 27, respectively. Front bearing housing 26 is secured to canned motor housing 20 by screws 23, and has a passage 9 therein which permits fluid to pass therethrough from the motor's cavity to discharge portion 6 of main pump casing 3. Retaining screws 28, 29 are provided to prevent front bearing 24 and rear bearing 25**, respectively, from rotating.

Motor housing 20 has at least one relief valve 38 which relieves excess internal pressure.

Auxiliary pump 40 includes auxiliary pump casing 43 which is secured to motor housing 20 by screws 44 with seals 45 used to prevent leakage and to insure proper alignment. By the connection of auxiliary pump casing 43 to motor housing 20 rear bearing housing 27 is compressed therebetween. Auxiliary pump 40 has positioned therein auxiliary impeller 48 which is secured to shaft 10 by conventional means, such as screw 46, for rotation therewith.

Recirculation line 50, which preferably is conventional piping, provides a conduit between the high pressure portion 6 of main pump casing 3 and the input of auxiliary pump casing 43. Recirculation line 50 is removably secured to main pump casing 3 and auxiliary pump casing 43 by conventional means such as pipe fittings 56 being connected to end portions of the recirculation line which are inserted into passages 52 and 54, in the secondary portion 6'' of the high pressure portion 6 of main pump casing 3 and the inlet portion of auxiliary pump casing 43, respectively.

The canned motor pump pressurized recirculation system of the present invention operates as follows. Mainstream fluid enters main pump casing 3 through low pressure portion or inlet 4. Main impeller 8, which is driven by shaft 10 of the motor, gives the fluid velocity so that it is transferred to and discharged from high pressure portion 6 through passage 52 and recirculation line 50 into auxiliary pump casing 43, whereat by the rotation of auxiliary impeller 48 by shaft 10 the fluid receives an increase in pressure which causes it to flow through the motor, thereby cooling the motor and bearings 24, 25, and then through passage 9 in front bearing housing 26 to discharge portion 6 in main pump casing 3, while maintaining the fluid at or near high or discharge pressure.

It is important to note that by the external recirculation line 50, i.e., a recirculation line not part of the main unit comprising the main pump 2, motor housing 20 and auxiliary pump 40, fluid flow from the high pressure portion 6 of main pump casing 3 to auxiliary pump casing 43 is unobstructed. Further, recirculation line 50 can readily be changed to that having a larger or smaller diameter and still further, devices for measuring the fluid flow therethrough or draining off heat or fluid from the mainstream fluid can easily be used with the recirculation line. Moreover, by the auxiliary impeller 48 being located in a separate casing, which is removably secured to the motor housing, and not in the rotor cavity, the impeller may be of any diameter and can easily be changed.

Figure 2:
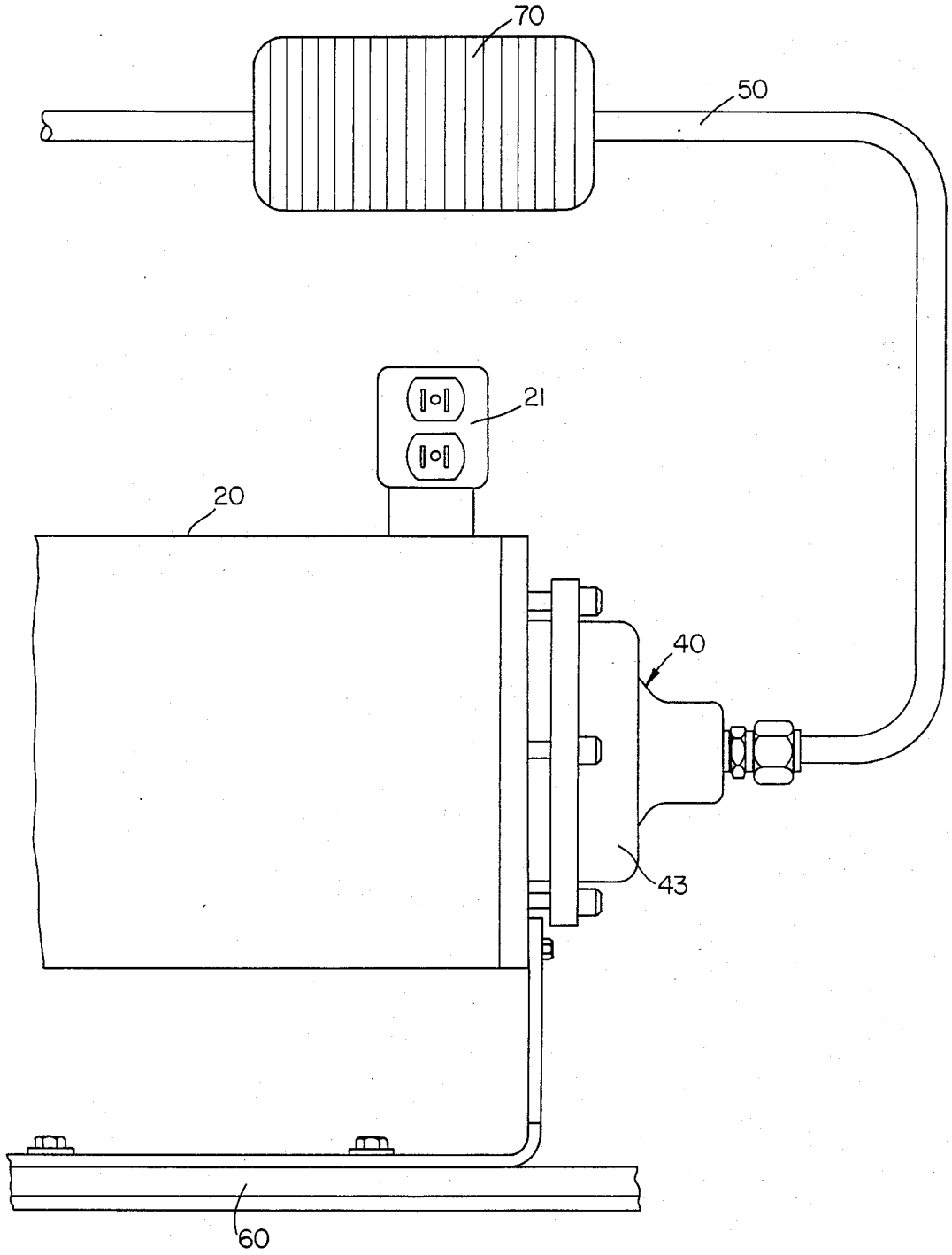
FIG. 2 is a partial plan view of a second embodiment of the canned motor pump pressurized recirculation system of the present invention.

FIG. 2 illustrates an alternative embodiment to overcome the problem wherein the pressure generated by main impeller 8, and perhaps auxiliary impeller 48 in auxiliary pump 40, is insufficient to prevent the fluid from boiling due to the heat of the motor. The fluid is cooled by heat exchanger 70 which is placed in recirculation line 50, preferably as close as conveniently possible to auxiliary pump casing 43. Heat exchanger 70 flashes-off or vaporizes some of the fluid discharged from high pressure portion 6 in main pump casing 3 to remove heat from the recirculated fluid before the fluid is inputted into auxiliary pump casing 43 thereby cooling the recirculated fluid before it is inputted into the auxiliary pump casing. Alternatively, the heat exchanger 70 can be cooled by conventional means such as brine or water to in turn cool the recirculated fluid.

Although certain embodiments have been described and illustrated, modification may be made herein, as by adding, combining or subdividing parts or by substituting equivalents while retaining advantages and benefits of this ivnention.

I claim:

1. A canned motor pump pressurized recirculation system which uses an enclosed motor pump, comprising:

A. a main unit, including:

a main pump;

an auxiliary pump comprising a casing and an impeller disposed therein;

motor means positioned between said main pump and said auxiliary pump for driving and for fluidly connecting said main pump and said auxiliary pump, said motor means including a rotor, a shaft associated with said rotor, a stator which surrounds said rotor, a sleeve positioned between said rotor and said stator, and means providing a flow passage from said auxiliary pump to a high pressure portion of said main pump through said sleeve; and B. A recirculation line positioned externally of said main unit and being connected between said main pump and said auxiliary pump, said recirculation line being adapted to pass fluid from said main pump unobstructedly to said auxiliary pump from which the fluid will be passed through said motor means to the high pressure portion of said main pump;

said auxiliary pump casing and impeller being removably secured to one end of said motor means with said impeller disposed externally of said sleeve.

2. The recirculation system according to claim 1, further comprising a heat exchanger connected to said recirculation line for removing heat from the fluid passing through said recirculation line.

3. The recirculation system according to claim 1, wherein said impeller is removably secured to one end of said rotor shaft.

4. A canned motor pump pressurized recirculation system, comprising:

a main inlet for providing driving fluid into said system;

a main pump having a high pressure portion which incudes a primary and secondary discharge portion for transferring the driving fluid from said main inlet to the primary and secondary discharge portions;

an auxiliary pump comprising a casing and an impeller disposed therein;

motor means positioned between said main pump and said auxiliary pump for driving said main pump and said auxiliary pump, said motor means including a housing, a rotor, a shaft associated with said rotor and having an end extending to the outside of said housing, a stator and a sleeve separating said rotor and stator, wherein said auxiliary pump impeller is removably secured to said end of said shaft and said auxiliary pump casing is removably secured to said motor housing;

a recirculation line positioned externally of said housing and being connected between said main pump and said auxiliary pump;

first means for passing fluid from said auxiliary pump into said motor means; and second means for passing fluid from said motor means to the high pressure portion of said main pump, wherein fluid from the secondary discharge portion of said main pump will be passed through said recirculation line and unobstructedly therefrom into said auxiliary pump and through said motor means to the high pressure portion of said main pump.

5. A pressurized recirculation system according to claim 4, wherein said second means includes a bearing housing having a passage which fluidly connects said motor means to the high pressure portion of said main pump.

* * * * *